United States Patent [19]

Nakagawa

[11] Patent Number: 4,520,560

[45] Date of Patent: Jun. 4, 1985

[54] APPARATUS FOR HOLDING A SLIDE FASTENER SLIDER

[75] Inventor: Toshiaki Nakagawa, Kurobe, Japan

[73] Assignee: Yoshida Kogyo K. K., Tokyo, Japan

[21] Appl. No.: 552,119

[22] Filed: Nov. 16, 1983

[30] Foreign Application Priority Data

Nov. 17, 1982 [JP] Japan ..... 57-173959[U]

[51] Int. Cl.[3] ..... B23P 19/04

[52] U.S. Cl. ..... 29/708; 29/408

[58] Field of Search ..... 29/408–410, 29/766–770, 33.2

[56] References Cited

U.S. PATENT DOCUMENTS

| | | | |
|---|---|---|---|
| 3,812,571 | 5/1974 | Dori | 29/768 |
| 3,844,016 | 10/1974 | Kawakami | 29/768 |
| 3,874,057 | 4/1975 | Kawakami et al. | 29/768 |
| 3,945,103 | 3/1976 | Fujisaki et al. | 29/768 |
| 3,956,813 | 5/1976 | Shigeno | 29/768 |
| 4,329,778 | 5/1982 | Doori . | |
| 4,397,454 | 8/1983 | Nagagawa | 29/768 |
| 4,416,060 | 12/1983 | Nagagawa | 29/766 |
| 4,437,233 | 3/1984 | Yoshieda | 29/408 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A slider holding apparatus comprises a support vertically slideable on a base for supporting a slider upside down with a pull tab received in a slit of the support, and a lever having a locking projection and pivotable on the base between a slider-holding position in which the locking projection projects into the slit to lock the pull tab and a slider-release position in which the locking projection is retracted out of the slit to unlock the pull tab. The support is normally urged upwardly by a first spring, and the lever is normally urged by a second spring to the slider-release position. The apparatus further includes means for detecting when the support as depressed against the bias of the first spring arrives at a predetermined lower position, and means, responsive to detection of the arrival of the support, for driving the lever to the slider-holding position against the bias of the second spring.

6 Claims, 9 Drawing Figures

APPARATUS FOR HOLDING A SLIDE FASTENER SLIDER

BACKGROUND OF THE INVENTION

1. Field of the Invention

The present invention relates to the production of slide fasteners, and more particularly to an apparatus for holding a slider in position during threading or mounting onto a slide fastener chain.

2. Prior Art

An automatic lock slider has a locking pawl that is movable into and out of a guide channel in a slider body in response to pivotal movement of a pull tab. For threading a slide fastener chain through such slider in the manufacture of a slide fastener, the slider must be held in such a manner that the locking pawl is retracted out of the guide channel to allow the passage of the fastener chain through the guide channel.

A known slider holder, as disclosed in U.S. Pat. No. 4,329,778 issued on May 18, 1982, has a support vertically slidably mounted on a base for supporting a slider body upside down, a slit in the support for receiving a pull tab hanging from the slider body, and a locking ball carried by the base, the support being normally urged upwardly by a (first) spring which is relatively strong. The ball is movable on the base between a slider-holding position in which the ball projects into the slit for engagement with the edge of an opening in the pull tab, and a slider-release position in which the ball is retracted out of the slit for releasing the pull tab. The ball is normally urged to the slider-holding position by a (second) spring. However, this prior holder is not satisfactory because of the following problems:

1. The degree of firmness of the engagement between the ball and the pull tab varies depending on the size of the pull tab's opening.

2. If the second spring is strong, it is not easy to insert the pull tab into the slit. On the contrary, if the second spring is weak, adequate engagement between the ball and the pull tab is difficult to achieve. In the latter case, if the first spring is considerably strong, the pull tab tends to accidentally come off the ball as the support is moved upwardly due to undue resilience of the first spring. Accordingly, it is necessary to control the resilience of each spring, which is laborious.

3. There is considerable resistance by the spring-biased ball when the slider is removed from the holder.

4. In order to have adequate engagement between the ball and the pull tab, an auxiliary spring is necessary for assistance to the second spring in urging the ball.

SUMMARY OF THE INVENTION

According to the present invention, a slider holding apparatus comprises a support vertically slidable on a base for supporting a slider upside down with a pull tab received in a slit of the support, and a lever having a locking projection and pivotable on the base between a slider-holding position in which the locking projection projects into the slit to lock the pull tab and a slider-release position in which the locking projection is retracted out of the slit to unlock the pull tab. The support is normally urged upwardly by a first spring, and the lever is normally urged by a second spring to the slider-release position. The apparatus further includes means for detecting when the support as depressed against the bias of the first spring arrives at a predetermined lower position, and means, responsive to detection of the arrival of the support, for driving the lever to the slider-holding position against the bias of the second spring.

It is therefore an object of the present invention to provide a slider holding apparatus in which a pull tab of a slider can be inserted into and withdrawn from a slit in a slider support without being obstructed by a locking projection, thus enabling easy placement and removal of the slider.

Another object of the invention is to provide a slider holding apparatus in which a slider can be held in position reliably without the necessity of controlling or adjusting the resiliences of two springs respectively acting on a slider support and a pull-tab locking lever.

Still another object of the invention is to provide a slider holding apparatus in which a pull tab can be locked by a locking projection with uniform and adequate firmness, irrespective of the size of the pull tab's opening.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
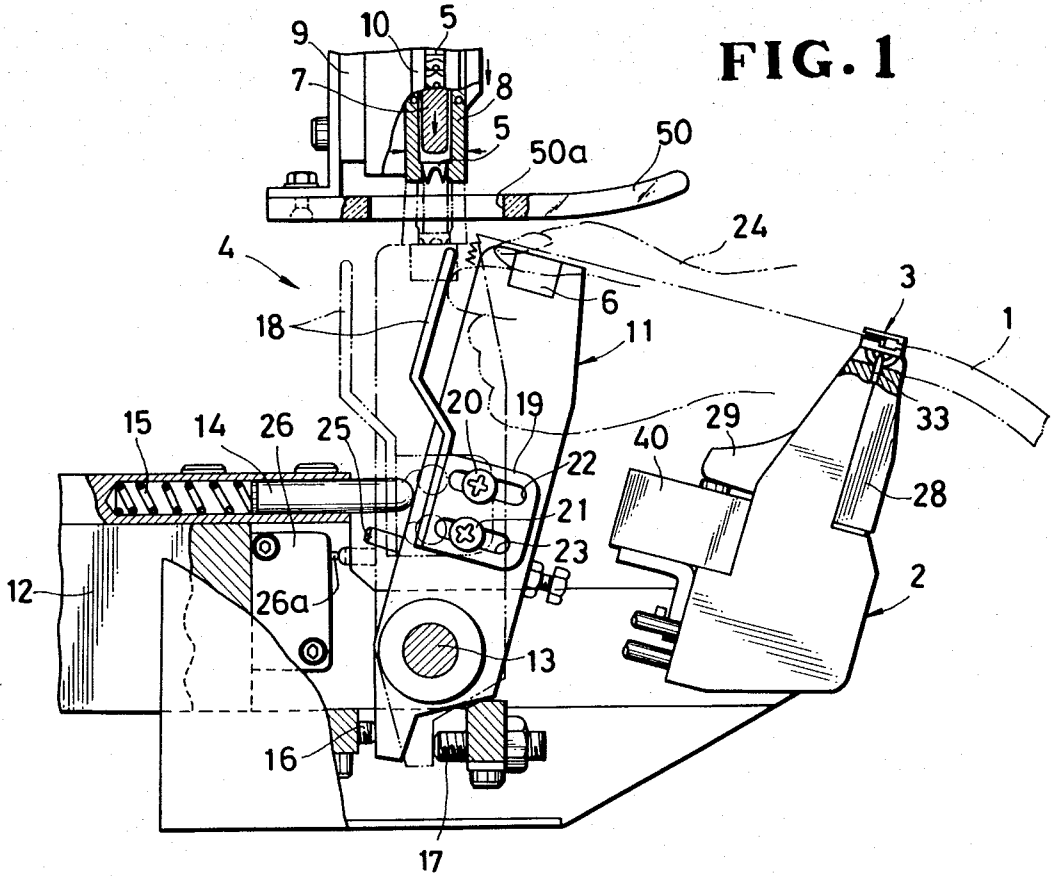
FIG. 1 is a fragmentary front elevational view, with parts broken away, of a slide-fastener finishing machine having a slider holding apparatus embodying the present invention.
Figure 4:
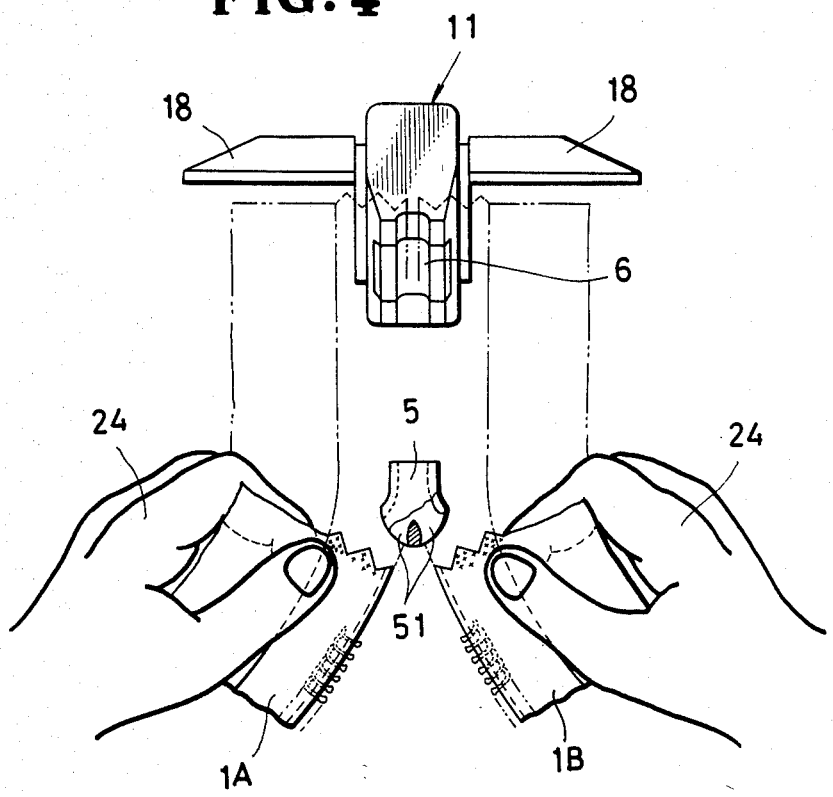
FIG. 4 is a plan view, with parts omitted, of the finishing machine of FIG. 1, illustrating the manner in which a pair of slide fastener stringers is threaded through the slider.

FIG. 1 shows a machine for finishing a slide fastener (not shown) from a slide fastener chain 1 including a pair of fastener stringers 1A, 1B (FIG. 4). The finishing machine includes an apparatus 2 for holding a slider 3 in position during the threading of the fastener chain 1 through the slider 3, and an apparatus 4 for attaching a bottom end stop 5 to the fastener chain 1.

The attaching apparatus 4 includes a coacting die 6 and a punch 7. The punch 7 is vertically movably mounted within a pocket 8 which is vertically movably supported by an upper frame 9 and which is receptive of a bottom end stop 5 supplied from a chute 10.

The die 6 is fixed to an upper end of an elongate die-holder 11 that is pivotally mounted on a lower frame 12 by means of a shaft 13. The die-holder 11 is pivotable about the shaft 13 between an advanced or upright position (indicated by dash-and-two-dot lines in FIG. 1) in which the die 6 is vertically aligned with the punch 7, and a retracted or inclined position (indicated by solid lines in FIG. 1). The die-holder 11 is normally urged to the retracted position by a pushing rod 14 and a compression spring 15, both carried by the lower frame 12. The rightward and leftward movements of the die-holder 11 are adjustably restricted by a pair of stops 16, 17 respectively, each stop comprising a threaded bolt.

A pair of push plates 18, 18 (FIG. 1 and 4) is attached to the die-holder 11 on its opposite sides, for a purpose described below. Each plate 18 is adjustably secured to the die-holder 11 by an attaching plate 19 and a pair of threaded screws 20, 21 extending through a pair of parallel slots 22, 23, respectively, in the attaching plate 19, the slots extending perpendicularly to the longitudinal axis of the die-holder 11. In FIG. 1, when the push plates 18, 18 are pushed by hands of the worker as described below, the die-holder 11 is moved from the solid-line position to the dash-and-two-dot-line position against the bias of the spring 15. With the die-holder 11 thus disposed in its advanced position, the punch 7 and the pocket 8 are lowered as a unit initially, i.e. until a lower end of the pocket 8 abuts the upper end of the die-holder 11, whereafter only the punch 7 is lowered further to force the bottom end stop 5 out of the pocket 8 and to attach the bottom end stop 5 to the fastener chain 1. Upon arrival of the die-holder 11 at the advanced position, an actuator 26*a* of the limit switch 26 is hit by a pin or projection 25 of the die-holder 11 to produce an electrical signal for a purpose described below. Attached to the lower end of the upper frame 9 is a transparent safety cover 50 having an aperture 50*a* through which the pocket 8 (with the punch 7 therein) is projectable as it is lowered.

As shown in FIGS. 1, 2A, 2B, 2C and 3, the holding apparatus 2 generally includes a base 27 fixed to the lower frame 12, an elongate slider-support 28 (hereinafter referred to as "support") longitudinally slidably mounted on the base 27, and a pull-tab locking lever 29 (hereinafter referred to as "lever") pivotally mounted on the base 27 by a pin 38.

The support 28 has at its upper end a seat 30 for supporting thereon a slider body 32 upside down, and a longitudinal slit 31 opening into the seat 30 for receiving a pull tab 33 hanging from the slider body 32. The support 28 is slidable on the base 27 between an upper position (FIG. 2A) and a lower position (FIG. 2B), and the support 28 is normally urged to the upper position by a compression spring 34 (hereinafter referred to as "first spring"). The upward movement of the support 28 is restricted by a stop 35 mounted on the support 28 and projecting into a slot 36 in the base 27. The stop 35 comprises a screw threadedly extending through the support 28.

The lever 29 has a locking projection 29*a* and is pivotable on the base 27 between a slider-holding position (FIGS. 2B and 2C) in which the locking projection 29*a* projects into the slit 31 in the support 28 for engagement with an edge of the pull tab's opening 37, and a slider-release position (FIG. 2A) in which the locking projection 29*a* is retracted out of the slit 31 for allowing the pull tab 33 to be inserted thereinto and also for releasing the pull tab 33. The lever 29 is normally urged to the slider-release position (FIG. 2A) by a compression spring 39 (hereinafter referred to as "second spring").

The holding apparatus 2 also includes a detecting unit (described below) for detecting when the support 28, as manually pressed downwardly against the bias of the first spring 34, arrives at the lower position (FIG. 2B), and a driving unit (described below) operatively connected to the detecting unit for driving the lever 29 from the slider-release position (FIG. 2A) to the slider-holding position (FIGS. 2B and 2C) against the bias of the second spring 39.

Figure 2A:
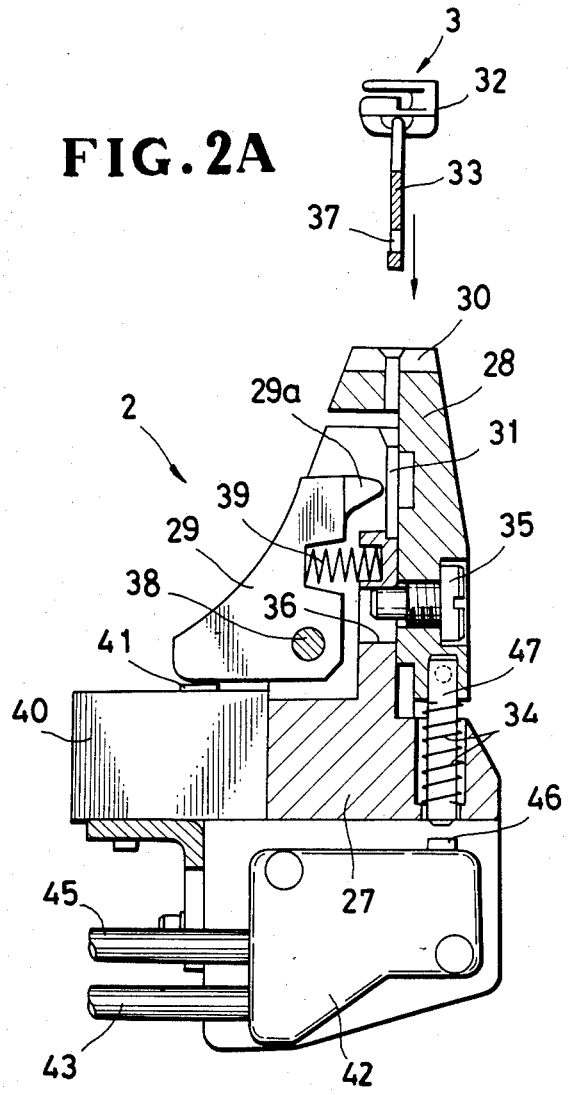
FIGS. 2A, 2B and 2C are enlarged vertical cross-sectional views of the slider holding apparatus, illustrating the manner in which a slider is held in position.
Figure 2B:
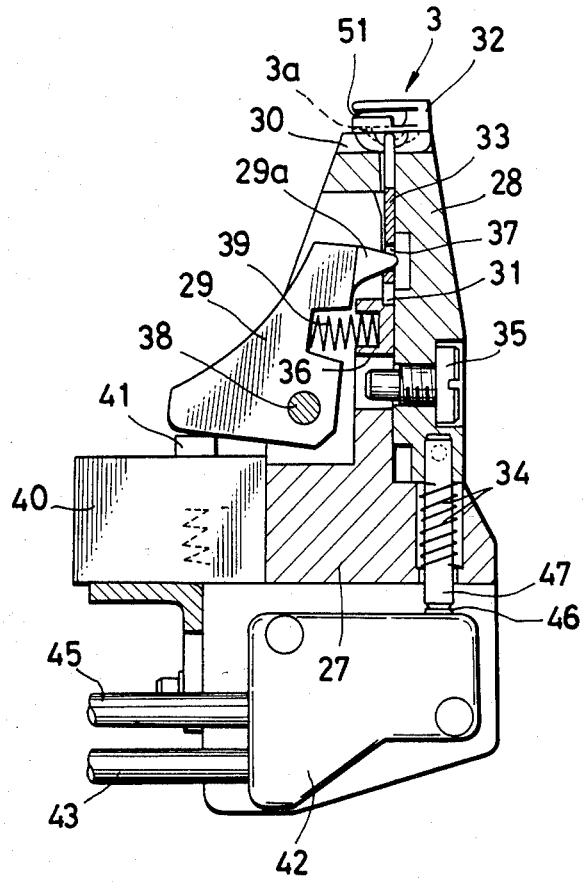
Figure 2C:
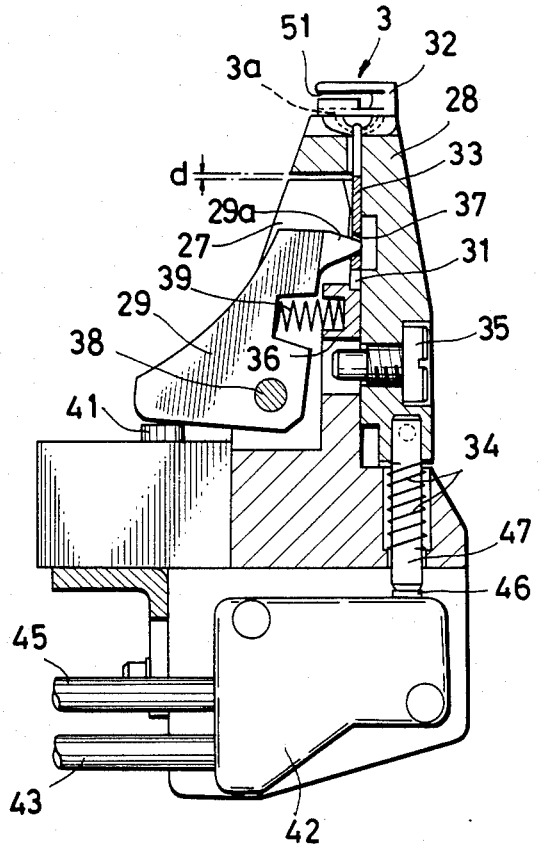

The driving unit comprises a fluid-pressurizable cylinder 40 mounted on the base 27 and having a piston rod 41. The detecting unit comprises a normally closed change-over valve 42, a first pipe 43 connecting the change-over valve 42 to a fluid pressure source 44 (FIG. 5) via the junction 56 between third and fourth pipes 54, 55, and a second pipe 45 connecting the change-over valve 42 to a valve 48, the change-over valve 42 having a sensing rod 46. The support 28 has at its lower end a pushing rod 47 for pressing the sensing rod 46 of the change-over valve 42, upon arrival of the support 28 at the lower position (FIG. 2B), to open the change-over valve 42 for allowing fluid pressure from the fluid pressure source 44 to be transmitted to the valve 48 via the third pipe 54, the first pipe 43 and the second pipe 45. The valve 48 is opened by this fluid pressure from the second pipe 45, allowing the fluid pressure to be transmitted to the cylinder 40 via the third pipe 54, the fourth pipe 55 and a fifth pipe 49. Thus the piston rod 41 is projectable from the cylinder 40 by the fluid pressure to push the lever 29 to the slider-holding position (FIGS. 2B and 2C). The valve 48 and the third, fourth and fifth pipes 54, 55, 49 are only schematically shown in FIG. 5.

Figure 3:
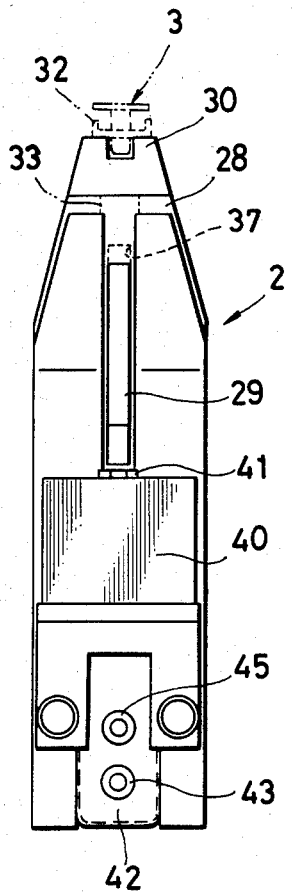
FIG. 3 is a side elevational view of the slider holding apparatus of FIG. 2A, with the slider shown by dash-and-two-dot lines.

In operation, with the lever 29 disposed in the slider-release position (FIG.2A), the slider 3 is manually placed on the support 28 upside down in such a posture that a front or flared end of the slider 3 faces in a direction opposite to the attaching apparatus 4, i.e. rightwardly in FIG. 1. At that time, the slider body 32 is supported on the seat 30 upside down, and the pull tab 33 hanging from the slider body 32 is inserted into the slit 31 in the support 28, as shown in FIG. 3.

Then the support 28 with the slider 3 thereon is manually pressed downwardly, and upon arrival of the support 28 at the lower position (FIG. 2B), the sensing rod 46 of the change-over valve 42 is depressed by the pushing rod 47 to open the change-over valve 42, allowing fluid pressure from the fluid pressure source 44 to be transmitted to the valve 48 via the third pipe 54, the first pipe 43 and the second pipe 45. The valve 48 is opened by this fluid pressure from the second pipe 45, allowing the fluid pressure from the source 44 to be transmitted to the cylinder 40 via the third pipe 54, the fourth pipe 55 and the fifth pipe 49. Thus the piston rod 41 projects from the cylinder 40 under the fluid pressure to push the lever 29 to the slider-holding position (FIGS. 2B and 2C), bringing the locking projection 29*a* into engagement with an edge of the opening 37 in the pull tab 33.

Subsequently, with the pull tab 33 thus locked by the locking projection 29*a*, the support 28 is slightly returned from the position of FIG. 2B to the position of FIG. 2C, i.e. by a distance d, under the resilience of the first spring 34 when the downward pressure (by the worker's hands) is relieved from the support 28. This returning of the distance d causes a locking pawl 3*a* (FIGS. 2B and 2C) of the slider 3 to be retracted out of a Y-shaped guide channel 51 (FIG. 4) of the slider 3, allowing the fastener chain 1 to be threaded through the channel 51.

After having been threaded through the slider 3, the fastener chain 1 is pulled by hand from the solid-line position to the dash-and-two-dot-line position of FIGS. 1 and 4, i.e. until its leading end portion (a prospective bottom end portion of a slide fastener) is placed on the die 6 disposed in the retracted position.

In FIG. 1, with the leading end portion of the fastener chain 1 placed on the die 6, the push plates 18 are pushed by hand forwardly or to the left to bring the die-holder 11 from the retracted position (solid lines) to the advanced position (dash-and-two-dot lines). As a result, the die 6 with the fastener chain's leading end portion placed thereon has been vertically aligned with the punch 7.

Upon arrival of the die-holder 11 at the advanced position, the projection 25 of the die-holder 11 pushes the actuator 26*a* of the switch 26 which produces an electrical signal to initiate lowering of the pocket 8 with the punch 7 therein. The punch 7 and the pocket 8 are lowered as a unit initially, i.e. until the lower end of the pocket 8 abuts the upper end of the die holder 11, whereafter only the punch 7 is lowered further to force the bottom end stop 5 out of the pocket 8 and to attach the bottom end stop 5 to the fastener chain's leading end portion.

Figure 5:
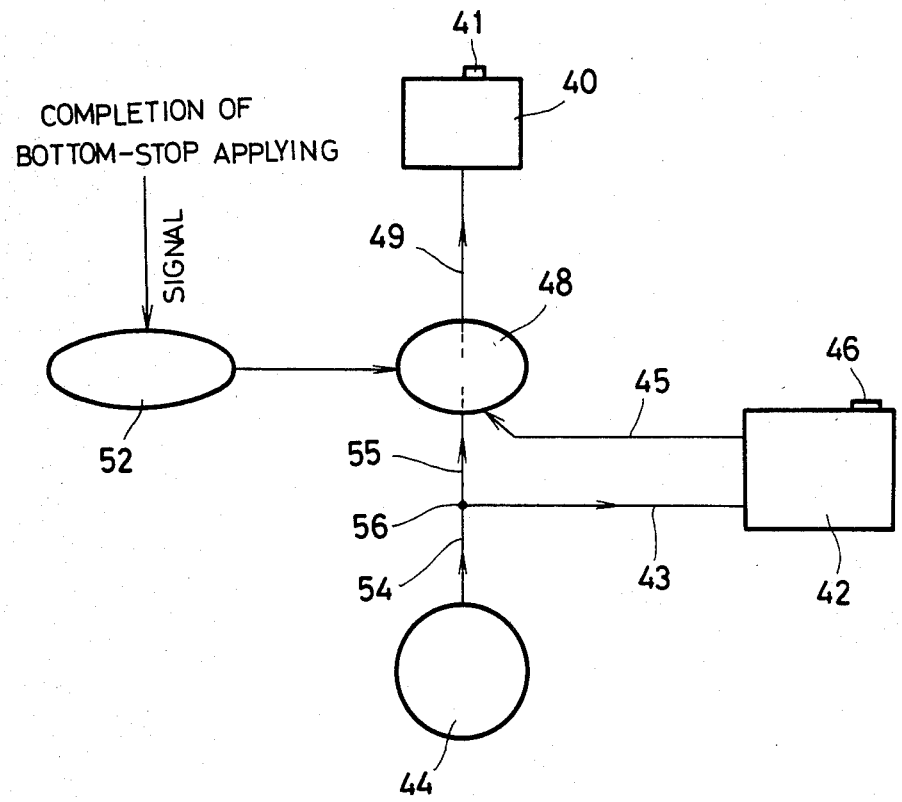
FIG. 5 is a schematic diagram of a fluid-pressure circuit for operating a locking-lever driving means.

As shown in FIG. 5, when the attaching of the bottom end stop 5 is completed, an electrical signal is issued in a known manner to energize an electrical circuit 52 for the valve 48. The valve 48, which has been opened since the change-over valve 42 was opened as the support 28 was lowered, is thereby returned to its initial closed position to discontinue flowing of the pressurized fluid from the fluid pressure source 44 into the cylinder 40. The lever 29 is returned to the retracted position (FIG. 2A) to allow the support 28 to be returned to the upper position (FIG. 2A). This returning of the support 28 in turn causes the change-over switch 42 to assume its initial closed position. The slider 5 can then be removed by hand from the support 28, during which time the pull tab 33 is withdrawn from the slit 31 in the support 28 without being obstructed by the locking projection 29*a* of the lever 29.

With this arrangement, since the locking projection 29*a* of the lever 29 is retracted out of the slit 31 in the support 28 not only during the inserting of the pull tab 33 into the slit 31 but also during the withdrawing of the pull tab 33 therefrom, easy placement and removal of the slider 3 can be achieved.

Another advantage of the holding apparatus 2 is that the slider 3 can be held in position reliably without the necessity of controlling or adjusting the resiliences of the first and second springs 34, 39 respectively acting on the support 28 and the pull-tab locking lever 29. Further, the pull tab 33 can be locked by the locking lever 29 with uniform and adequate firmness, irrespective of the size of the opening 37 in the pull tab 33.

Figure 6:
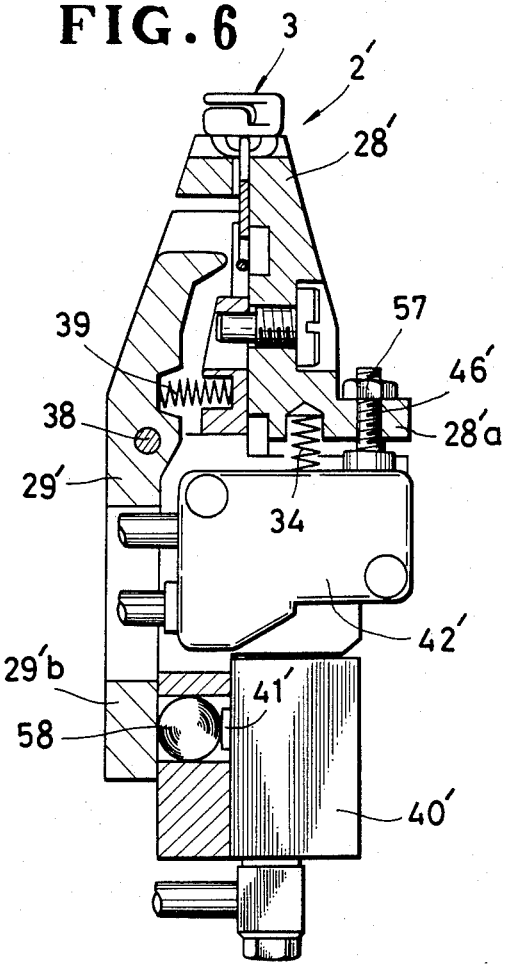
FIG. 6, appearing with FIG. 3, is a cross-sectional view showing a modified form of the slider holding apparatus.

FIG. 6 illustrates a modified holding apparatus 2' in which an elongated (pull-tab locking) lever 29' is used and in which a fluid-pressurizable cylinder 40' is disposed below a change-over valve 42'. Upon energization of the cylinder 40', a piston rod 41' projects from the cylinder 41' to push a ball 58 and thus the lever's lower extension 29'*b*, causing the lever 29' to pivot in a clockwise direction. Accordingly, the holding apparatus 2' is compact and vertically elongate, compared with the holding apparatus 2 of FIGS. 1–3. Further, a sensing rod 46' of the change-over valve 42' threadedly extends through an arm 28'*a* of the support 28' and is vertically adjustably secured thereto by a nut 57 so that the support's lower position in which the change-over valve 42' is actuated to open, is adjustable depending on the length of the pull tab and the size of the pull tab's opening.

Figure 7:
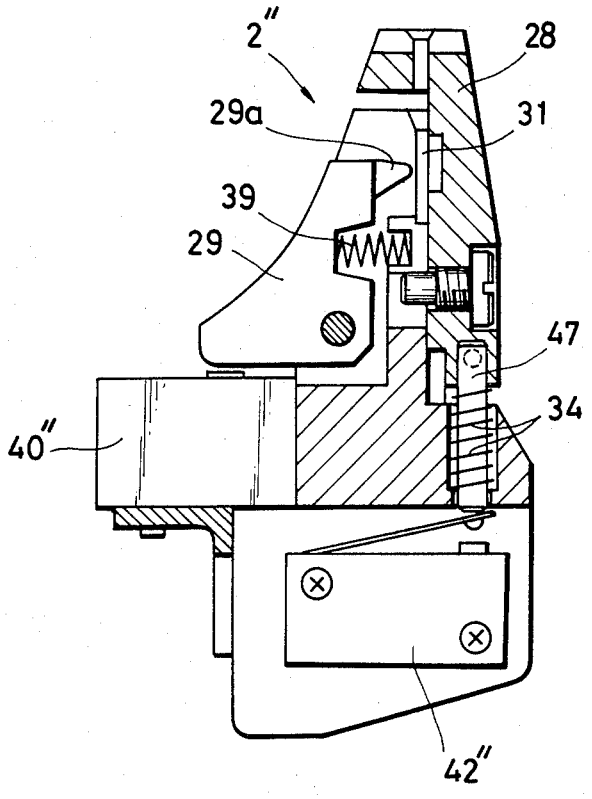
FIG. 7 is a cross-sectional view showing another modified form of the slider holding apparatus.

FIG. 7 illustrates another modified holding apparatus 2'' in which the detecting unit comprises a limit switch 42'' and the driving unit comprises a solenoid-operated plunger 40'' electrically connected with the limit switch 48''. This arrangement makes the holding apparatus compact and less costly.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for holding a slider in position during threading onto a slide fastener chain, the slider including a slider body and a pull tab pivotally connected to the slider body on its upper side and having an opening, said apparatus comprising:

(a) a base;

(b) an elongate support vertically slidably mounted on said base, said support having at its upper end a seat for supporting thereon the slider body upside down, and a longitudinal slit opening into said seat for receiving the pull tab hanging from the slider body supported on said seat, said support being slidable on said base between an upper position and a lower position;

(c) a first spring acting between said base and said support to normally urge the latter to said upper position;

(d) means for detecting when said support, as manually pressed downwardly against the bias of said first spring, arrives at said lower position;

(e) a lever pivotally mounted on said base and having a locking projection, said lever being pivotable between a slider-holding position in which said locking projection projects into said slit for engagement with an edge of the opening of the pull tab, and a slider-release position in which said locking projection is retracted out of said slit for releasing the pull tab;

(f) a second spring acting between said base and said lever to normally urge the latter to said slider-release position; and (g) means, responsive to detection of the arrival of said support by said detecting means, for driving said lever from said slider-release position to said slider-holding position against the bias of said second spring.

2. An apparatus according to claim 1, said driving means comprising a fluid-pressurizable cylinder mounted on said base and having a piston rod, said detecting means comprising a normally closed change-over valve, a first pipe connecting said change-over valve to said fluid pressure source, and a second pipe connecting said change-over valve to said cylinder, said change-over valve having a sensing rod for being depressed, upon arrival of said support at said lower position, to open said change-over valve for allowing fluid pressure from said fluid pressure source to be transmitted to said cylinder, said piston rod being thus being projectable from said cylinder by the fluid pressure to push said lever to said slider-holding position.

3. An apparatus according to claim 2, said sensing rod threadedly extending through a lower portion of said support and longitudinally adjustably secured thereto.

4. An apparatus according to claim 2, including a pushing rod mounted on said support at its lower end for pressing said sensing rod of said change-over valve upon arrival of said support at said lower position.

5. An apparatus according to claim 1, said detecting means comprising a limit switch having an actuator for being pressed, upon arrival of said support at said lower position, to energize said limit switch, said driving means comprising a solenoid-operated plunger electrically connected to said limit switch for being operative, upon actuation of said limit switch, to push said lever to said slider-holding position.

6. An apparatus according to claim 5, including a pushing rod mounted on said support at its lower end for pressing said actuator of said limit switch upon arrival of said support at said lower position.

* * * * *